US005227577A

United States Patent [19]

Eich et al.

[11] Patent Number: 5,227,577

[45] Date of Patent: Jul. 13, 1993

[54] DEVICE FOR FIRING AMMUNITION

[75] Inventors: Johannes Eich, Troisdorf; Gerhard Kordel, Nuremberg; Matthias Kuhla, Troisdorf, all of Fed. Rep. of Germany

[73] Assignee: Dynamit Nobel Aktiengesellschaft, Troisdorf, Fed. Rep. of Germany

[21] Appl. No.: 905,454

[22] Filed: Jun. 29, 1992

[30] Foreign Application Priority Data

Jun. 29, 1991 [DE] Fed. Rep. of Germany ..... 4121590

[51] Int. Cl.[5] ..... F41A 19/61; F41A 19/63; F42B 5/08; F42C 11/04

[52] U.S. Cl. ..... 89/28.05; 102/202; 102/209; 102/282; 102/472

[58] Field of Search ..... 89/1.814, 28.05, 135; 102/202, 209, 206, 472, 282; 42/84

[56] References Cited

U.S. PATENT DOCUMENTS

| | | | |
|---|---|---|---|
| 2,640,417 | 6/1953 | Bjork et al. | 89/1.814 |
| 3,563,177 | 2/1971 | Ritchey | 42/84 |
| 4,207,796 | 6/1980 | Wornock | 89/28.05 |
| 5,088,381 | 2/1992 | Lamargue et al. | 102/209 |
| 5,115,743 | 5/1992 | Löffler | 102/472 |

FOREIGN PATENT DOCUMENTS

| | | |
|---|---|---|
| 634648 | 2/1983 | Switzerland . |
| 1416095 | 12/1975 | United Kingdom . |

*Primary Examiner*—David H. Brown

*Attorney, Agent, or Firm*—Antonelli, Terry, Stout & Kraus

[57] ABSTRACT

A device for firing ammunition includes a combustion chamber accommodating several propellant charge members which latter contain a propellant charge and an ignition system for igniting the propellant charge. A fixedly disposed primary coil which receives an ignition signal is provided at the combustion chamber while a secondary coil is arranged in each propellant charge member, this secondary coil being connected to a resistor initiating the ignition system. The magnetic field, changing with time, which is produced by the primary coil penetrates the combustion chamber and induces a current in the secondary coils of each propellant charge member at the same time so that the ignition systems of all propellant charge members are simultaneously activated and ignite all propellant charges at once. On account of the simultaneous ignition of the propellant charge members, rapid firing sequences can be attained.

15 Claims, 2 Drawing Sheets

DEVICE FOR FIRING AMMUNITION

BACKGROUND OF THE INVENTION

This invention relates to a device for firing ammunition having a combustion chamber that contains a plurality of charge members which are ignitable by a primary coil surrounding the combustion chamber.

Modular propellant charge members have been developed for the firing of projectiles; these members can be inserted in varying numbers in a combustion chamber of a weapon. By selecting a specific number of charge members, all ranges can be covered. DE 3,815,436 Al describes such a propellant charge member of modular construction which contains, as the propellant charge, propellant charge grains embedded in a synthetic resin matrix. The propellant charge member can be designed as a cylindrical body and contains a longitudinally extending channel, a central firing facility being arranged on the wall of this channel. The known modular propellant charge members are designed for automatic feeding and are ignited by an external firing activation by the breech of the weapon. In the seal of the combustion chamber, a propellant charge igniter is inserted which is initiated by a firing mechanism, for example, in the form of a firing pin. The propellant charge igniter ignites, with an ignition jet extending into the combustion chamber, initially solely the central firing means of the first of the axially mutually aligned, series-disposed propellant charge modules. Since the ignition must first be conducted from one module to the next, a time delay occurs until all of the propellant charge members have been ignited. Simultaneous ignition of all propellant charge members is impossible by means of such conventional propellant charge igniters. There is furthermore the disadvantage that the special propellant charge igniter pertains to each shot and must be adapted to the geometrical dimensions of the breech or to the charge employed. Thereby a great volume of items must be kept in storage.

DE 2,734,169 Al discloses a device for the contactless transmission of electrical energy for the pyrotechnical igniter of a projectile. The electrical ignition energy is transmitted from a primary coil to a secondary coil which coil is connected to the pyrotechnical igniter. The secondary coil and the igniter are mounted on the side of the projectile facing the breech; whereas the primary coil for the excitation of the secondary foil is integrated in the breech of the weapon in immediate vicinity of the secondary coil. The disadvantage of this device resides in that the known ignition system permits only the initiation of the ignition means of a single propellant charge member. The simultaneous ignition of several modular propellant charge members arranged one below the other is not possible with this ignition system.

Based on the required strength of the seal closing off the combustion chamber against the high loads during the firing and for reducing the eddy current losses in the primary coil due to the short-term high current pulse in the primary coil, the breech of the weapon must be manufactured from a solid nonmagnetic material. Since the magnetic coupling between the primary coil located in the breech and the secondary coil in the combustion chamber is established only with the interconnection of a nonmagnetic material, and thus-produced magnetic field decreases with the square of the distance, the degree of efficiency of energy transmission is poor and/or limited. Furthermore, the cavity surrounding the primary coil in the breech leads to reduction of the strength of the entire breech system.

SUMMARY OF THE INVENTION

This invention is based on the object of providing a device for firing ammunition electrically, the ignition system of which is simplified, exhibits a high reliability, and permits a simultaneous ignition of several charge members located in the combustion chamber of the device. This object has been attained in accordance with this invention by providing a device which comprises a combustion chamber accommodating several propellant charge members, each member containing a propellant charge and an ignition means for the ignition of the propellant charge; a fixedly disposed primary coil for receiving an ignition signal provided adjacent a wall of the combustion chamber; and a secondary coil arranged in each propellant charge member; said secondary coil being connected to a resistor means for initiating the ignition means of each charge member.

In the device of this invention for the firing of ammunition, ignition of the individual propellant charge members disposed in the combustion chamber takes place inductively. A fixedly located primary coil producing an ignition signal of a high field strength is arranged at the periphery of the combustion chamber; whereas a secondary coil is provided in each propellant charge member. The secondary coil is connected to an ignition means resistor of an electrical ignition means integrated into each propellant charge member, this ignition means initiating or causing the ignition of the propellant charge. The magnetic field generated by the primary coil and changing with time penetrates the charge space and induces a current in the secondary coils of the propellant charge members so that the electrical ignition means of all of the propellant charge members are simultaneously activated, and all propellant charges ignite all at once, i.e. at the same time, or simultaneously. On account of the simultaneous ignition of the propellant charge members, rapid firing sequences can be achieved with the device of this invention. A change in the magnetic field as a function of time can advantageously be produced by discharging a charged capacitor—the ignition capacitor—through the primary coil. The energy stored in the capacitor is transferred to the primary coil. A magnetic field results, which has the form of a forced damped periodic oscillation, whereby the damping decrement and the change over time are determined essentially by the capacitance of the capacitor, the inductance of the primary coil, and the ohmic loss component.

Furthermore, the breech for closing off the combustion chamber and the part of the weapon defining the combustion chamber can be of very simple structure or construction. Since the primary coil is not integrated into the breech per se but, rather, is provided within the periphery of the combustion chamber, the provision of a perforation or cavity in the breech for the accommodating of a suitable ignition system is unnecessary. The breech or at least its part facing the combustion chamber can be made of a solid nonmagnetic material, e.g. stainless steel×5 MnCr 18 13 or ×50 CrMnNin 22 9 according to DIN 17440 and consequently has high strength against great loads during firing of the ammunition. Instead of these metal types also e.g. ceramic may be used as solid nonmagnetic material. The primary coil is suitable for the ignition of differing types of charges. There is no necessity for maintaining an expensive inventory for several propellant charge igniters to be specifically adapted to the geometrical dimensions of the individual propellant charge members. The secondary coil and the electrical means for ignition are integrated into each propellant charge member.

The primary coil advantageously has such a length that its effective range extends over the entire combustion chamber. Upon the generation of an ignition signal by way of the primary coil, the combustion chamber is penetrated completely by the magnetic field produced by the primary coil so that the energy from the primary coil can be coupled into the secondary coils of the propellant charge members over the entire length of the combustion chamber. The combustion chamber can be equipped with a specific number of propellant charge members, depending on the required range. Independently of the position of the propellant charge members in the combustion chamber, a safe ignition of each individual propellant charge member is ensured at all times.

The primary coil suitably encompasses the interior of the combustion chamber. The primary coil can be, for example, a cylindrical coil with helical windings entirely surrounding the combustion chamber so that the combustion chamber in the interior of the coil is penetrated by an approximately homogeneous magnetic field.

The secondary coil can be arranged in the center of each propellant charge member. Preferably, the secondary coil is arranged together with the resistor of the electrical ignition means in a body which is located in a recess of the propellant charge member. The cylindrical body is encompassed by the propellant charge which latter is then centrally fired.

Preferably, the cylindrical body consists of a combustible material so that no appreciable residues remain after combustion of the propellant charge.

BRIEF DESCRIPTION OF THE DRAWINGS

One embodiment of the invention will be described in greater detail hereinafter with reference to the accompanying drawings wherein.

DETAILED DESCRIPTION OF THE INVENTION

Figure 1:
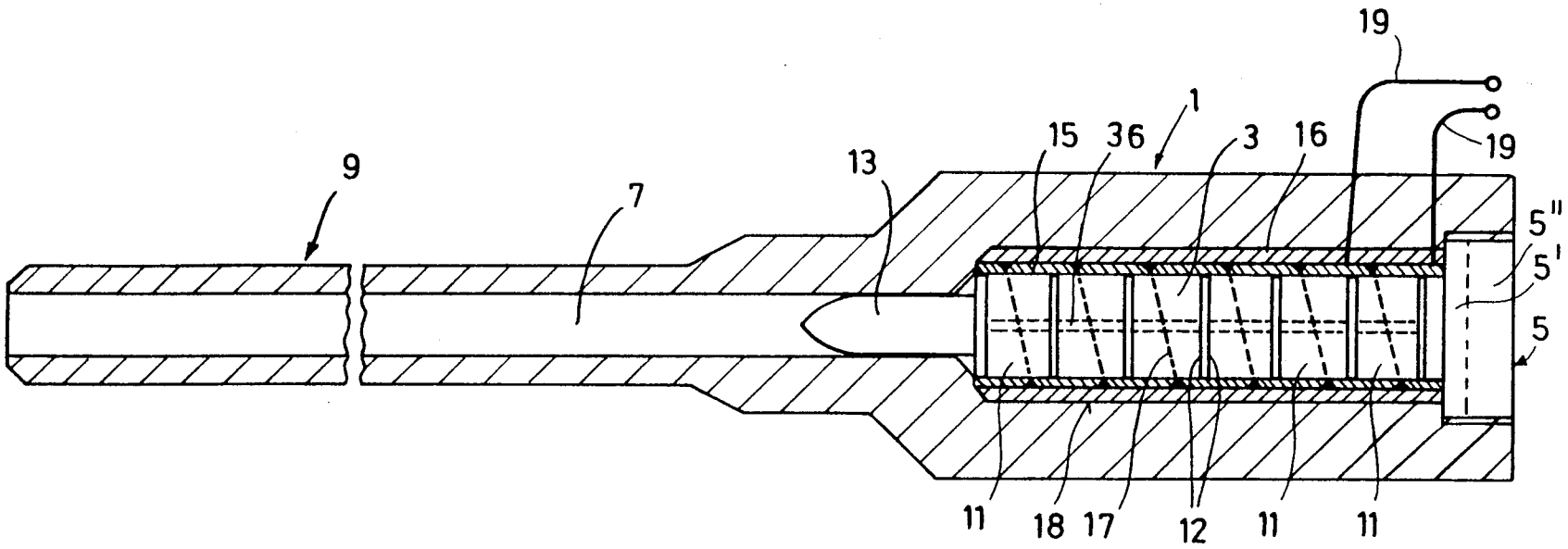
FIG. 1 is a second through the device for firing ammunition i a schematic view.

FIG. 1 illustrates a section through the device for firing ammunition in a schematic view. The device consists of a solid cylindrical base member 1 containing a cylindrical combustion or charge-receiving chamber 3. At its rearward end, the combustion chamber is closed off by a threadable, solid breech 5 shown in side view. The part 5' of the breech 5 facing the combustion chamber 3 is made of a solid nonmagnetic material as heretofore mentioned; whereas the rear part 5'' is made of normal weapon steel is also the base member 1 and the other parts connected therewith. The combustion chamber 3 passes over into the barrel 7 of the projectile tube 9 adjoining the forward end of the base member 1. The combustion chamber 3 here contains, in total, six cylindrical propellant charge members 11 of modular design which are arranged in series and in mutually axial alignment in the combustion chamber 3 also shown in side view. The charge members 11 are provided with a central longitudinal channel 36, indicated by dotted lines, and are each enclosed by combustible case members not shown for the sake of simplicity. The case members are so designed that they can be connected with each other as is well known in the art—see e.g. DE-U-70 00 615 —by plug connection as indicated by lines 12. Depending on the required range of the projectile 13, the combustion chamber 3 can be equipped with a different number of propellant charge members 11. This charge is dimensioned so that it can accommodate maximally six propellant charge members 11, as shown in FIG. 1. The ignition of the charges contained in the individual propellant charge members 11 takes place inductively.

In order to couple the electrical ignition energy into the arrangement, the cylindrical combustion chamber 3 is entirely surrounded by a tubular bobbin or support 15. The bobbin carries the windings of a primary coil 17—only one for each charge member 11 is indicated with a dotted line—extending over the entire length of the combustion chamber. It consists of a nonmagnetic material as heretofore mentioned wherein the helical windings of the coil 17 are embedded in helical grooves on the outer surface of the bobbin 15. The windings are thus arranged in very close proximity to the center of the combustion chamber 3. The electrical connecting wires 19 of the primary coil 17 are extended out through the base member 1. An ignition signal of an ignition device not illustrated in FIG. 1 is applied to the connecting wires 19. The bobbin 15 itself is surrounded by a further cylindrical tube 16 which is in close contact with the outer surface of the bobbin 15 and made also of a nonmagnetic material as previously mentioned. The tube 16 serves to shield the coil 17 and to partially screen the magnetic field produced by it. Both the bobbin 15 and the tube 16 are inserted in a corresponding bore 18 of the base member 1 with press fit and are to be considered as a component of base member 1 in contrast to the propellant charge members 11 and the projectile 13 which have to be reloaded after each shot. The bobbin 15 serves also to contain the propellant charge members 11, i.e. the diameter of the combustion chamber 3 is determined by the inner diameter of the bobbin 15.

Figure 2:
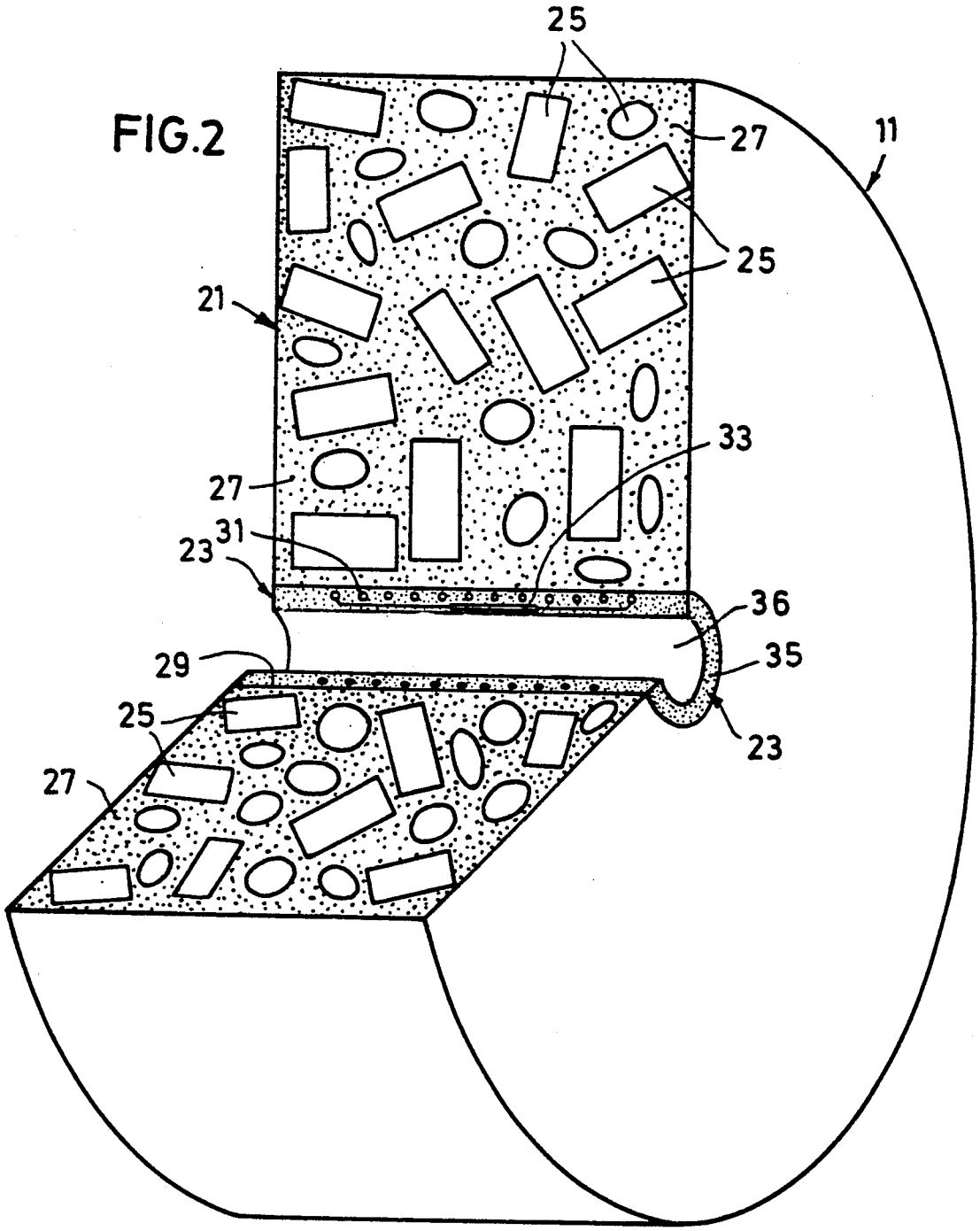
FIG. 2 shows a propellant charge member in a partially sectional view; a secondary coil together with an ignition means resistor and an ignition means being arranged in the center of the charge member.

FIG. 2 shows one of the modular propellant charge members 1 to be disposed in the combustion chamber 3 in a partially sectional view with the combustible outer case member being omitted. The propellant charge member 11 is designed as a cylindrical molded body which contains the actual propellant charge 21 and an ignition member 23 for igniting the propellant charge. The propellant charge 21 consists of propellant grains 25 embedded in a synthetic resin matrix 27. The synthetic resin matrix 27 effects mutual fixation of the propellant grains 25 so that the propellant charge member 11 constitutes a compact body. The cylindrical ignition member 23 is arranged in a longitudinally extending cylindrical recess 29 in the center of the propellant charge member 11.

The ignition member 23 consists of a combustible material and accommodates a secondary coil 31 connected in parallel with the ignition means resistor 33 of the ignition means 35, for example, in the form of a heating wire. The heating wire is coated with a readily ignitable pyrotechnical composition and is surrounded by the ignition means 35 contained in the ignition member 23. The ignition means 35 may consist e.g. of a plasticizer containing nitrocellulose formed to a tube by pressing and made porous thereafter as known in the art or nitrocellulose containing paper wrapped to a tube. The tubular ignition member 23 exhibits a central longitudinal channel 36. The helical windings of the secondary coil 31 and the heating wire with the ignition means 35 are integrated into the annular cylindrical body 23.

For igniting the propellant charge members 11 disposed in the combustion chamber 3, a suitable ignition signal is applied to the primary coil 17. The magnetic field of the primary coil 17, changing with time, penetrates the cylindrical combustion chamber 3 entirely and consequently, a current is induced in the secondary coil 31 of each propellant charge member 11. This current flows through the ignition means resistor 33 of the ignition means 35 connected with the secondary coil 31 of each propellant charge member 11. The ignition means resistor 33, coated with the pyrotechnical composition, of the propellant charge member 11 thereupon begins to heat up and initiates the ignition means 35 of the ignition member 23 which latter, in turn, centrally fires the actual propellant charge 21 of the propellant charge member 11. Coupling of the ignition energy from the primary coil 17 to the secondary coils 31 of the individual propellant charge members 11 can proceed over the entire combustion chamber so that all propellant charge members 11 are ignited simultaneously. Based on the simultaneous ignition, rapid firing sequences can be obtained. Since the primary coil 17 for the inductive ignition of the propellant charge members 11 is arranged at the combustion chamber 3, and there is no external ignition by an ignition system integrated into the breechblock, the structural design of the breechblock is also simplified. Furthermore, functional reliability is enhanced since mission tailored ignition of the propellant charge occurs even if, for example, in a propellant charge body 11 ignition by ignition body 23 should fail in an exceptional case.

What is claimed is:

1. A device for firing ammunition which comprises a combustion chamber accommodating several propellant charge members each member containing a propellant charge and an ignition means for the ignition of the propellant charge; a fixedly disposed primary coil for receiving an ignition signal provided adjacent a wall of combustion chamber; and a secondary coil arranged in each propellant charge member; said secondary coil being connected to a resistor means for initiating the ignition means of each charge member.

2. A device according to claim 1, wherein the combustion chamber and each propellant charge member exhibit a cylindrical cross section.

3. A device according to claim 1, wherein the secondary coil is located in the center of each propellant charge member.

4. A device according to claim 3, wherein an ignition member accommodating the secondary coil together with the resistor means and the ignition means is further provided; said ignition member being arranged in a recess on each propellant charge member.

5. A device according to claim 1, wherein an ignition member accommodating the secondary coil together with the resistor means and the ignition means is further provided; said ignition member being arranged in a recess on each propellant charge member.

6. A device according to claim 5, wherein the ignition member consists of a combustible material.

7. A device according to claim 1, wherein the primary coil surrounds the combustible chamber.

8. A device according to claim 7, wherein the secondary coil is located in the center of each propellant charge member.

9. A device according to claim 7, wherein an ignition member accommodating the secondary coil together with the resistor means and the ignition means is further provided; said ignition member being arranged in a recess on each propellant charge member.

10. A device according to claim 7, wherein the combustion chamber and each propellant charge member exhibit a cylindrical cross section.

11. A device according to claim 1, wherein the primary coil has such a length that its range of effectiveness extends over the entire length of the combustion chamber.

12. A device according to claim 11, wherein the primary coil surrounds the combustion chamber.

13. A device according to claim 11, wherein the secondary coil is located in the center of each propellant charge member.

14. A device according to claim 11, wherein an ignition member accommodating the secondary coil together with the resistor means and the ignition means is further provided; said ignition member being arranged in a recess on each propellant charge member.

15. A device according to claim 11, wherein the combustion chamber and each propellant charge member exhibit a cylindrical cross section.

* * * * *